US005792288A

United States Patent [19]

Masih et al.

[11] Patent Number: 5,792,288

[45] Date of Patent: Aug. 11, 1998

[54] TITANIUM ALLOY WITH SOLUTIVE AND INTERMETALLIC REINFORCEMENT

[75] Inventors: Rusk Masih; Nikolay Manoukian, both of Glastonbury, Conn.

[73] Assignee: Mite Ltd., Glastenbury, Conn.

[21] Appl. No.: 585,533

[22] Filed: Jan. 16, 1996

[51] Int. Cl.[6] ..... C22C 14/00

[52] U.S. Cl. ..... 148/421; 75/231; 75/245; 420/420

[58] Field of Search ..... 148/421; 420/420; 75/231, 245

[56] References Cited

U.S. PATENT DOCUMENTS

H887 2/1991 Venkataraman et al. ..... 420/420

2,880,089 3/1959 Vordahl ..... 420/420

3,069,259 12/1962 Margolin et al. ..... 148/421

3,479,289 11/1969 Van Wyk ..... 75/231

*Primary Examiner*—John Sheehan

[57] ABSTRACT

An alloy made of Titanium, Aluminum, Vanadium, and Copper. The combination enhances the strength of the metal. Such alloy can be used where high strength metal is required. When Molybdenum Sulfide is added to the alloy, it will provide a solid lubricating substance, which will reduce the friction coefficient by forming secondary structures, thus suppressing the phenomena of setting, which is typical for titanium alloys. Such alloy can be used where wear and tear is high under variable pressure such as gears. It can also be used where objects are moving with high velocity such as weapons.

2 Claims, 10 Drawing Sheets

TITANIUM ALLOY WITH SOLUTIVE AND INTERMETALLIC REINFORCEMENT

THE BACKGROUND OF THE INVENTION

Among the main advantages of titanium are: the high specific strength alloy (Ti—$7.1\times10^3$, Al—$3.0\times10^3$, Fe—$2.7\times10^3$, Cu—$2.5\cdot10^3$m) and corrosion resistance. Unfortunately, the low antifriction properties of titanium and its alloys ($f$=0.48 to 0.68), and the high adhesion ability significantly restrict their application as constructive materials. The proposed particular solutions, concerning the modification of working surfaces (oxidation, nitration, . . . etc.) of machine parts, don't solve the general problem. The alloying of titanium with different α- and β-stabilizers and the further thermal treatment do not improve significantly the setting resistance against the friction [1–3].

In choosing of structure components the authors [4,5] considered the well wettability and inertness of elements (Su, Pb, Mg, Ag) to titanium. Mg and its alloys are taken as the main components because the absence of mutual solubility of Ti—Mg system and the near zero edge angle of wettability.

The best solutions are proposed in [6]. The alloys Ti—Al (6 to 11% Al) were strengthened with dispersion high-melting compounds (ZrC, $H_fC$, TiC, $TiB_2$) due to their sufficient compatibility with Titanium. However, the coefficient of friction was reduced to $f\cong0.3$.

Analogous research was for systems: Ti—TiC, Ti—Cr, Ti—Cr—TiC [7–9]. The choice of Cr is connected with the fact, that it strengthens Ti. The samples are made by powder compacting and vacuum. The wearing characteristics of Ti—Cr—TiC are more preferable than those of Ti—TiC and Ti—Cr.

Other informations about the use of titanium and its alloys are known, no need to be discussed.

DISCUSSION OF PRIOR ART

According to molecular-mechanical theory of friction [10, 11], external friction is realized with the minimum energy, if the strength of adhesive connection between the contacting surfaces is less than the strength of lower layers, i.e., when the gradient of mechanical properties by the depth ($d\sigma/dx>0$) is positive. In that case all the friction deformation is concentrated within the thin surface layer, preventing the contacting materials from the penetrating destruction. The solid lubrication (sulphider, selenides, fluorides, etc.), that are present in compositions, formed of protecting layers on the conjugate surfaces ("secondary structures"), that significantly increase the workability of the friction joints.

The literature developed by the authors [4, 7] of the compositions: Ti—Al—Mg—ZrC [4] and Ti—Cr—TiC [7] partly correspond to the molecular-mechanical friction theory and are based on the following considerations:

Titanium reinforcement by Al or Cr,

The matrix alloy reinforcement by the neutral carbides (ZrC or TiC).

In our opinion, the best solution is the intermetallic reinforcement of Ti, alloyed with α- and β- stabilizing elements. This means that the solid (reinforcing) particles are included in the matrix not artificially (such that it does not provide a uniformity of their distribution by volume and dispersivness in the range 0.01 . . . 0.1 micrometer). The solid reinforcing particles are included in the matrix naturally, i.e. as a result of dispersive hardening. Then a metallic compatibility of phases is reached, i.e. incomplete consolidation of the system "Matrix-solid particles", abd a structural homogeneity. The sizes of reinforcing particles are easily controlled by the conditions of thermal treatment (hardening and aging). Their volume amount depends on the alloying degree with α- and β- Stabilizers.

SUMMARY OF THE INVENTION

1. The principles of development of antifriction materials, having structural models that correspond to molecular-mechanical friction and wear-resistance theory, are formulated. Namely:

provision of solvolytic and intermetallic mechanisms of hardening of the metallic matrix, including solid lubricating substances as components (sulfides, selenides, etc.).

The combination of solvolytic and intermetallic mechanisms of reinforcement significantly increases the wear resistance of the material. Such combination provides the friction contact "matrix-dispersion particles". The presence of solid lubricating substances, that form "secondary structures" on the conjugated surfaces, prevents the adhesive interaction of friction coupling and decreases the friction coefficient.

2. A new class of alloys with solvolytic (α-Ti) and intermetallic ($Ti_2Cu$) reinforcement is developed (Ti—(Al, V)—Cu) and an antifriction material (Ti—(Al,V)—Cu—$MoS_2$), based on the latter, it is developed-with high tribotechnical characteristics.

Dispersion particles $Ti_2Cu$ are coherently connected with matrix (α-Ti), and their sizes are controlled by thermal treatment (hardening and aging). The volume amount is controlled by alloying of (Cu).

EXPLANATION OF THE PARAMETERS OF THE DRAWINGS

α Phase (structure), pure Ti which has the hexagonal crystal grid.

$\alpha_2$ Phase (structure), Ti3Al which contains V and has the hexagonal crystal grid.

$\alpha_H$ Impact viscosity.

$\gamma$ Phase (alloy structure), represents the combination of the TiAl alloying with V.

$\gamma_1$ The modification of the $\gamma$ phase.

$\beta$ Phase (structure), pure Ti which has the cubic crystal grid.

$\delta$ Relative elongation of the sample due to shear.

$\sigma_B$ Shear strength.

$\psi$ Relative contraction of the sample due to shear f Coefficient of friction.

$I_h$ Coefficient of linear wearing.

L Liquid phase.

O Ti—3% Al—4.6% Cu—$MoS_2$ $\Delta$ Ti—3% Al—1.0% V—4.6 Cu—$MoS_2$

DETAILED DESCRIPTION OF THE INVENTION

Titanium is represented in two polymorphic modifications: low-temperature ($\alpha$-Ti) and high temperature ($\beta$-Ti). The lattice is hexagonal, dense-packaged (a=2.9503 Å, c=4.6834 Å; c/a=1.587 at 298 K). $\beta$-Ti is cubic, volume-centric (a=3.2820 Å, at 298 k). The polymorphic conversion of titanium $\alpha$-$\leftrightarrows\beta$- occurs at 1155.5 k. $\alpha$-Ti has 12 slipping planes and 18 surfaces of twinning, which explains setting phenomena at friction due to its adhesive transfer to counterbody. It was established, that the surpass of mass transfer is accomplished by solvolytic and intermetallic reinforcement.

Figure 1:
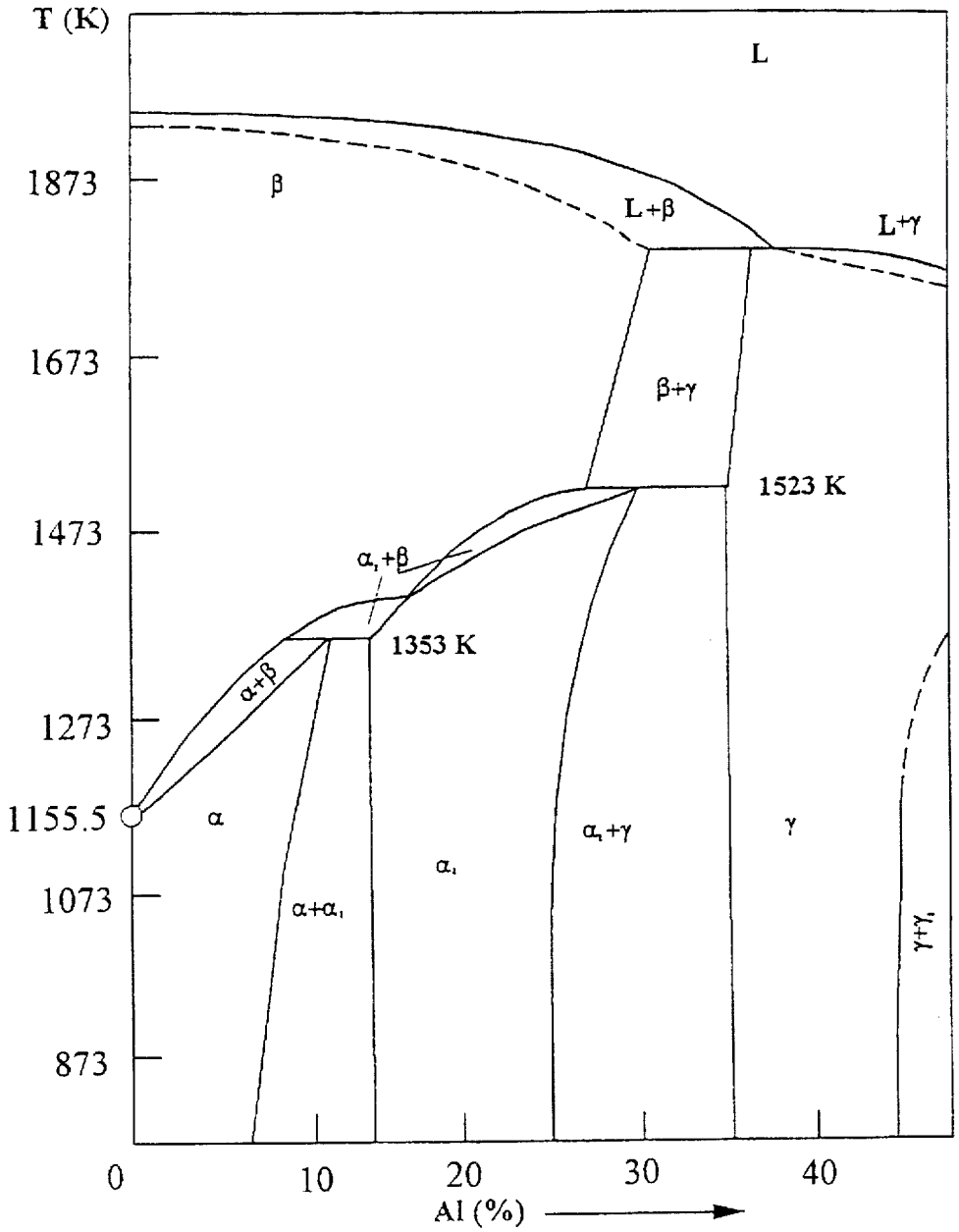
FIG. 1 The phase (structure) diagram of Ti—Al. System under variable temperature.

Aluminum is the main alloying element for titanium, as the carbon is for iron. FIG. 1 shows the part of Ti—Al alloy diagram. Note that Al increases the temperature of allotropic conversion of Ti and forms a large area of hard solutions with $\alpha$-Ti, that extends to 6% Al. The alloys containing 6 to 12% AL are found in two-phase area ($\alpha+\alpha_2$), where $\alpha_2$-superstructure ($Ti_3Al$). FIG. (2*a*) shows the influence of Al on the properties of $\alpha$-Ti. A noticeable decrease of plastic properties for alloys with 6 to 8% Al is observed, whereas the alloys with 10% Al are destroyed in a brittle manner. It is connected with the $\alpha$2-phase formation. Virtually the $\alpha$2-phase in Ti—Al alloys begins to be separated at ~5% Al [12].

The Ti—Al system is basic, on which the industrial titanium alloys are obtained. Ti—Al strength is increased by alloying with $\beta$- stabilizers in quantities close to maximum solubility in $\alpha$-Ti. Coefficients of reinforcement for different $\beta$-stabilizers are computed. FIG. 1 shows that the solubility of $\beta$-stabilizers in $\alpha$-phase is insignificant (0.2 to 3.2%). Al increases the solubility of $\beta$-stabilizers in $\alpha$-Ti. Cr, Fe, Mo highly reinforce the $\alpha$-phase. Previously chromium was considered as a promising component. However, when the embattlement of Ti—Al—Cr alloys was discovered (as a result of eutectic conversion), its practical importance decreased. In addition, the eutectic conversion with transition metals (Cr, Mn, Fe, etc.) occurs too slowly and is not fulfilled at the usual rates of cooling [13, 14].

TABLE 1

Maximum solubility of alloying element in $\alpha$-Ti

| Element | Ser. no. | Solubility mass % | Solubility T, K | Reinforcement coefficient |
|---|---|---|---|---|
| Al | 13 | 7.5 | 873 | 3.5 |
| V | 23 | 3.2 | 873 | 5.0 |
| Cr | 24 | 0.5 | 938 | 26.0 |
| Fe | 26 | 0.2 | 858 | 20.0 |

TABLE 1-continued

Maximum solubility of alloying element in $\alpha$-Ti

| Element | Ser. no. | Solubility mass % | Solubility T, K | Reinforcement coefficient |
|---|---|---|---|---|
| Ni | 28 | 0.2 | 1043 | — |
| Cu | 29 | 2.1 | 1071 | 6.6 |
| Mo | 42 | 0.8 | 873 | 14.0 |
| W | 74 | 0.8 | 873 | 5.5 |

Most of alloying elements (Al, Cr, Mn, Fe, etc.) in titanium increase the ratio c/a and brings it close to 1.633, that makes the slip by prismatic surfaces difficult and decreases the plasticity. Vanadium (V), on the contrary, increases c/a and thus increases the $\alpha$-phase ability of plastic deformation [16]. V and Mo impedes $\alpha$2-phase formation, and therefore it is possible to increase the amount of Al in (Ti—Al—V) (FIG. 3) and (Ti—Al—Mo) alloys without fear of embattlement.

The soluble mechanism of reinforcement [16] is the base in manufacturing of titanium alloys, for Ti—Al—($\beta$-Me) in particular. By the structure they are divided into:

$\alpha$- alloys (low-alloyed)

($\alpha+\beta$)- alloys (middle-alloyed)

$\beta$- alloys (high-alloyed)

$\alpha$ alloys are not reinforced thermally. The eutectic decomposition of $\beta$-phase into $\alpha$-phase for ($\alpha+\beta$) alloys and the intermetallic connection does not occur, since the $\beta$-hard solution is in equilibrium with $\alpha$-phase. The eutectic decomposition in $\beta$-alloys brings to abrupt deterioration of mechanical properties. Their usage is excluded because of their high brittleness [16].

Figure 2A:
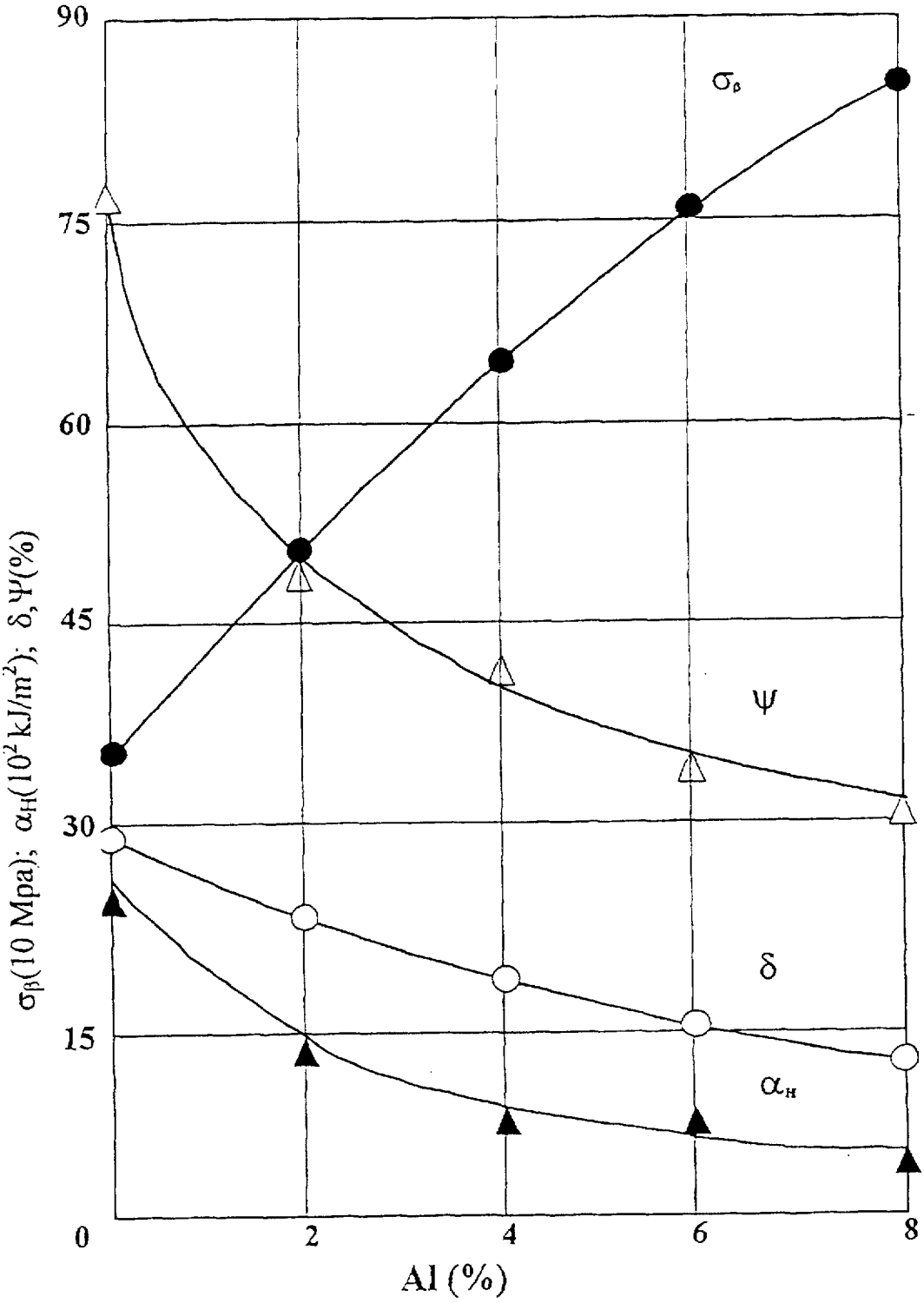
FIG. 2*a* The influence of Al on the mechanical properties of Ti..
Figure 2B:
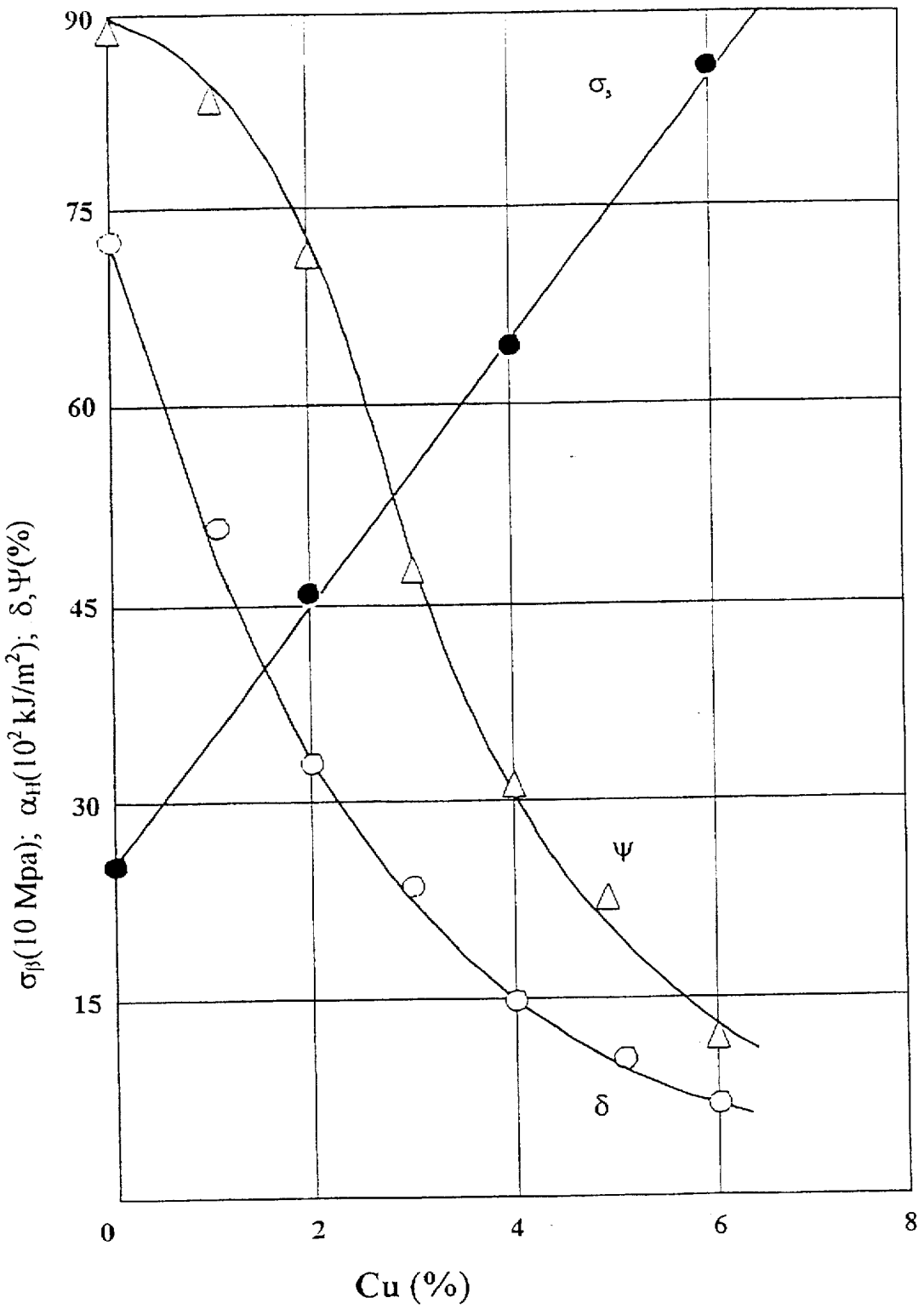
FIG. 2*b* The influence of Cu on the mechanical properties of Ti after hardening at 1173 K Temperature.
Figure 4:
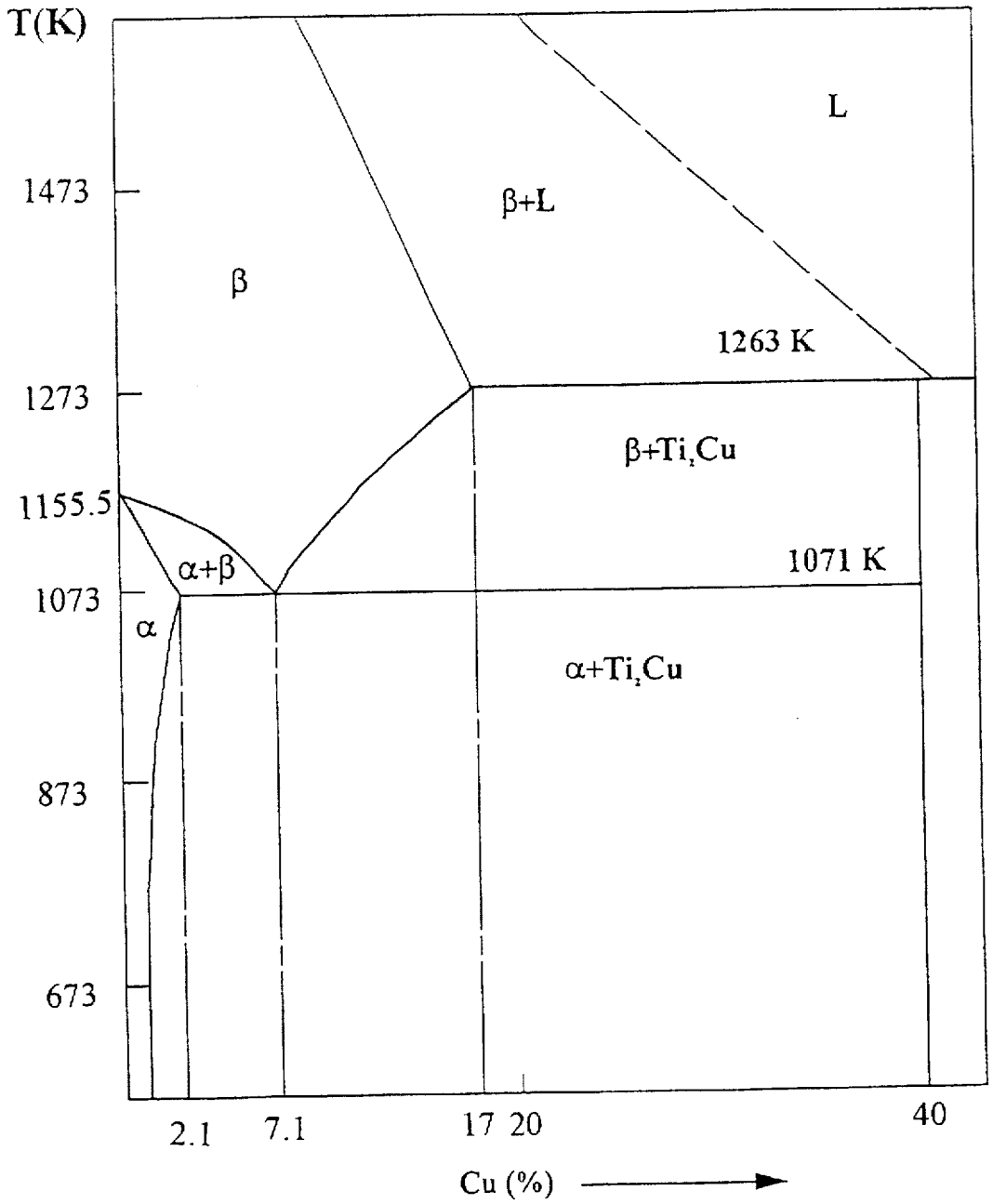
FIG. 4 The phase (structure) diagram of Ti—Cu. System under variable temperature.

The alloys Ti—Cu are almost the only alloys among all titanium alloys with transitory metals, the thermal reinforcement of which is accomplished as a result of decomposition of supersaturated hard solution and extraction of intermetallic in dispersion condition [$Ti_2Cu$]. It is in this alloy, which is alloyed with Al (and V), i.e. Ti—Al—Cu, where both mechanisms of reinforcement are developed together soluble (Ti—Al) and intermetallic (Ti2Cu). FIGS. 4 and 2(*b*) show the diagrams of condition and properties of Ti—Cu alloys. As it is seen in FIG. 4, Cu decreases the conversion temperature of Ti ($\beta\leftrightarrows\alpha$). The limit of solubility of Cu in $\alpha$-Ti at 1071 k is 2.1%. Above this amount $\beta$-Ti is eutectallide $Ti_2Cu$. Eutectic includes 7.1% Cu and also corresponds to temperature 1071 k. The influence of Cu on properties of titanium (FIG. 2*b*) is analogous to that of Al (FIG. 2*a*).

Thus, the analysis of titanium alloys as a structural model, that satisfies the main tribotechnical principles, allows to choose the dispersionally-hardening alloy Ti—(Al,V)—Cu as an antifriction material.

Figure 3:
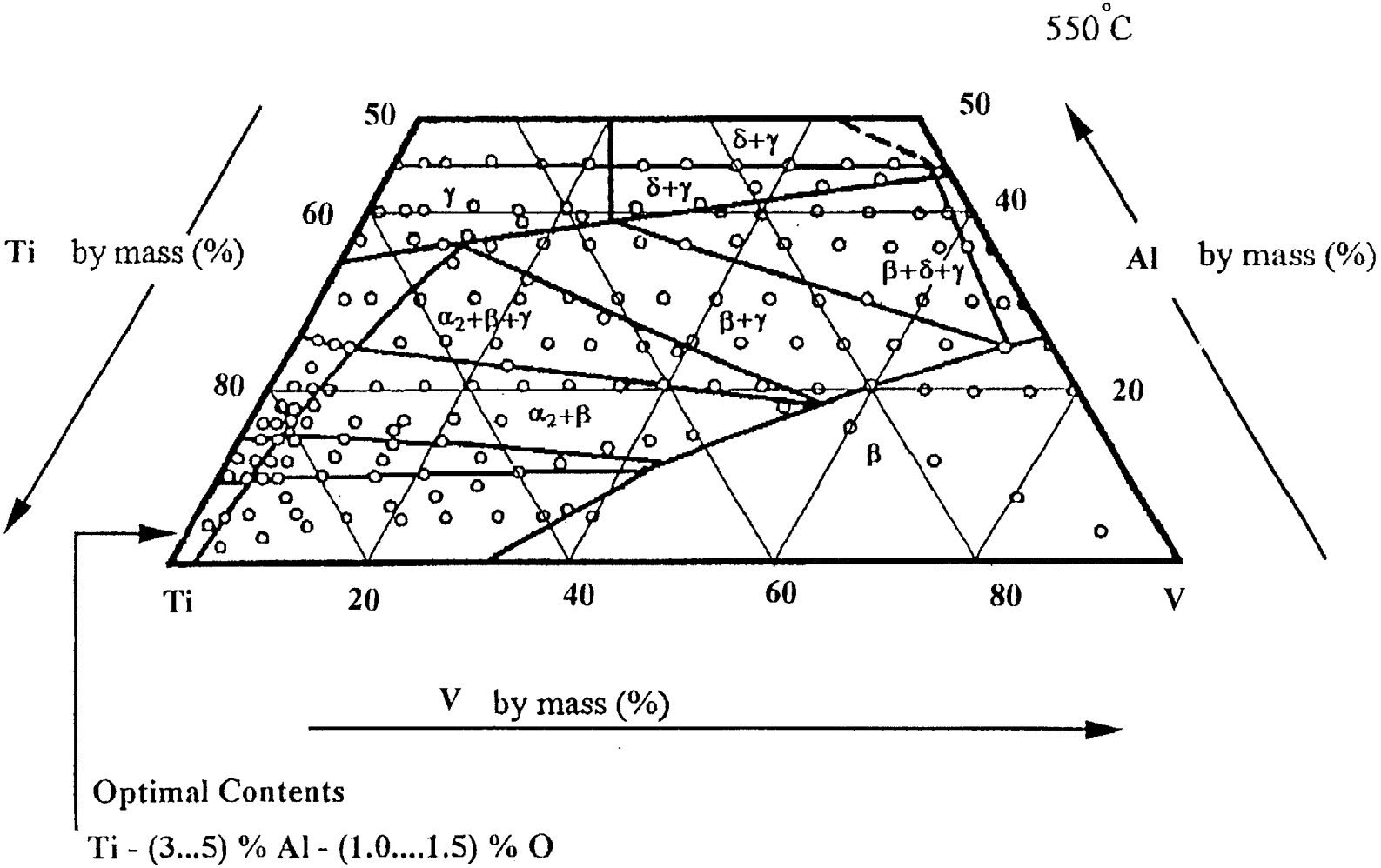
FIG. 3 Isometric sections of system Ti—Al—V.
Figure 5:
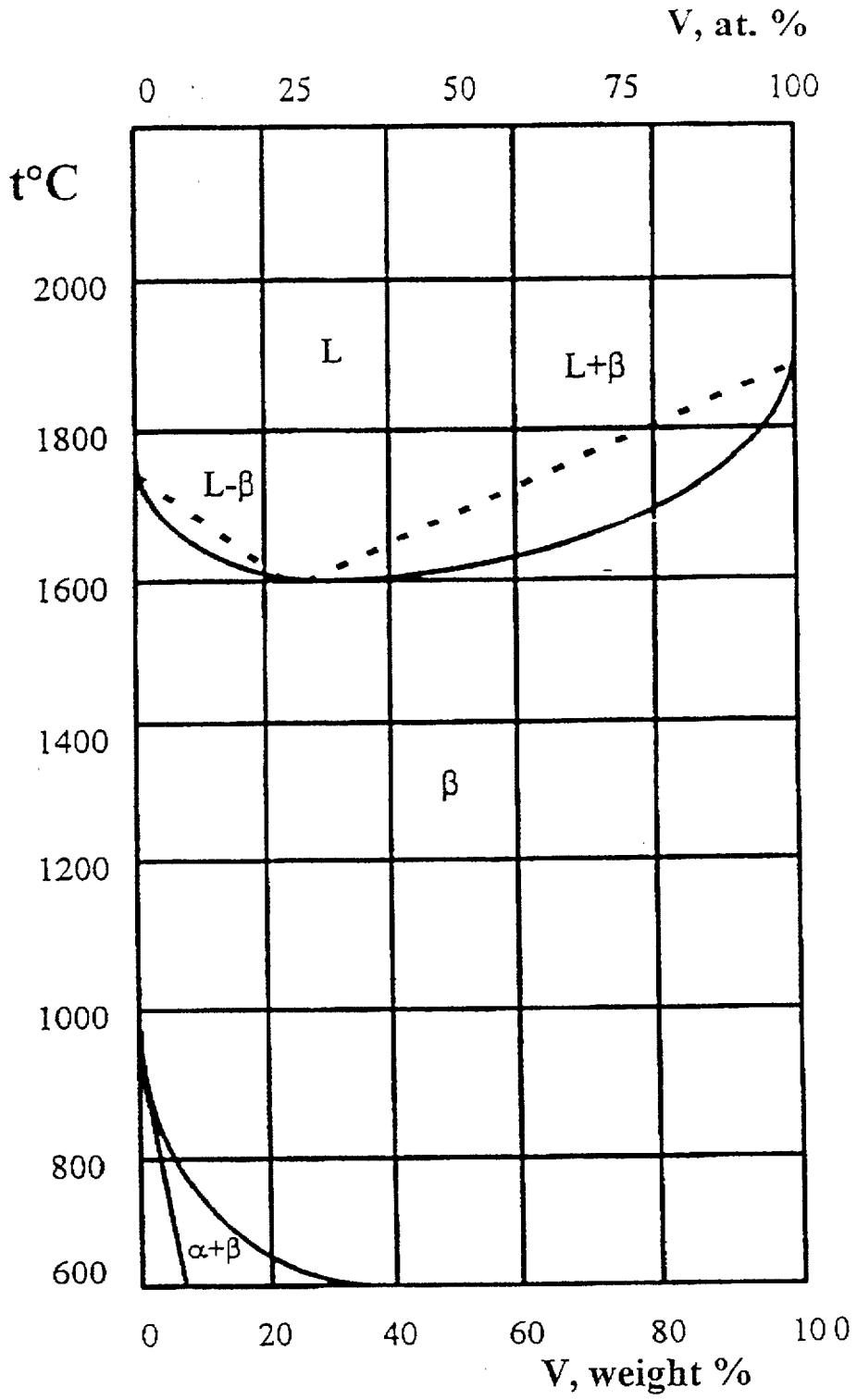
FIG. 5 The phase (structure) diagram of Ti—V. System under variable temperature.

The intervals of concentration of alloying elements must correspond to the conditions of diagrams Ti—Al (FIG. 1), Ti—V (FIG. 5) and Ti—Cu (FIG. 4). So the Al content must vary in range 3 to 5%. The alloy reinforcement up to 3% Al is not significant (FIG. 2*a*). $\alpha_2$-phase begins above 5% Al. However, Vanadium, (V) inclusion broadens the interval to 4 to 7% Al. The range for Cu is 2.1 to 7.1%, i.e. it must exceed the limit of solubility in $\alpha$-Ti (>2.1% Cu) and must be limited by the eutectic compound (7.1% Cu). The V content is determined by the diagrams of condition Ti—V (FIG. 5) and Ti—Al—V(FIG. 3). In Ti—V system at 293 k the solubility of V in $\alpha$-Ti. is ~0.5 to 0.6%, in Ti—Al—V it increases (due to Al) up to 1.0 to 1.5% V. The structural monotony, that provides the soluble mechanism of reinforcement is a necessary condition for Ti—Al—V alloy. So the amount of V must be within the range of full solubility, i.e. 1.0 to 1.5%. As mentioned before, the solubility of V in α-Ti depends on the Al amount. For example at 873 k, the solubility of V in α-Ti is increased from 3.5 to 4.5% with increasing the Al amount from 4 to 7% [17].

The Ti—Al—V—Cu—$MoS_2$ alloys were obtained by powder metallurgy, thermal processes which allows to keep the aggregate condition of $MoS_2$. The thermal stability of $MoS_2$ is: 723 k in air; 1073 k in hydrogen, 1373 k in vacuum and 1708 in argon.

The powders of industrial manufacturing were taken as initial materials: Ti, Al, V, Cu, $MoS_2$ (natural). Since the alloys Ti—Al—V—Cu and Ti—Al—V—Cu—$MoS_2$ are intended for products, that will work under hard loading conditions, the structural porosity is extremely undesirable. From this sense the compactness of titanium alloys is fulfilled by heat extrusion [18], that compose the processes of molding. The optimal extrusion parameters are: temperature Te=1373±50 k, the heating duration (and structural formation) $\sigma_E$=1.5–2.0 hr, the matrix angle αm=90° to 120°, the coefficient of extract $4 \leqq \lambda e \leqq 6$. Under this conditions almost a non porous structure of alloys is obtained.

The reinforcing thermal treatment of Ti—Al—V—Cu and Ti—Al—V—Cu—$MoS_2$ alloys is fulfilled according to common recommendations [12,16]:

1) Hardening from β-area at temperature, close to (α+β) ⇆β conversion;

2) aging at 623 to 723 k.

The scheme of structural decomposition of Ti—Al—V—Cu at the reinforcing thermal treatment process is:

$$\beta \rightarrow \alpha' \rightarrow (\alpha\text{-Ti}) + Ti_2Cu$$

It is seen, that both solutive (α-Ti)and intermetallide ($Ti_2Cu$) mechanisms of reinforcement are realized. Consequently, the possibility of obtaining the aging titanium alloys becomes real.

The inclusion of $MoS_2$ doesn't involve structural changes. The microrentgenospectral analysis confirms the safety of aggregate condition of $MoS_2$. The microphotography of the intermetallic. $Ti_2Cu$ by electron microscope (REM-200) shows, that the dispersion particles (0.01 to 0.3 mem) are coherently connected with the matrix, i.e. with α-Ti. The content of particles by volume is controlled by Cu alloying, and their sizes-by the temperature and duration of aging.

The mechanical properties of titanium alloys are shown in Table 2. One can see the semi-genes meaning at the best manufacturing levels of (α+β)- and β- titanium alloys, subjected to reinforcing thermal treatment (hardening and aging). The comparison shows, that the properties of Ti—Al—V—Cu alloys are preferable, especially by viscosity, which is the most important characteristics of constructional materials, subjected to dynamic loading.

TABLE 2

Mechanical properties of titanium alloys (after hardening and aging).

| Alloys | $\sigma_b$, MPa | HB, MPa | δ, % | ψ, % | × $10^2$ kJ/m$^2$ |
|---|---|---|---|---|---|
| Ti-3% Al-4.6% Cu | 1332 | 4170 | 11.8 | 17.2 | 3.2 |
| Ti-3% Al-4.6% Cu-4.5% | 1103 | 4460 | 4.8 | 6.4 | 2.3 |

TABLE 2-continued

Mechanical properties of titanium alloys (after hardening and aging).

| Alloys | $\sigma_b$, MPa | HB, MPa | δ, % | ψ, % | × $10^2$ kJ/m$^2$ |
|---|---|---|---|---|---|
| $MoS_2$ | | | | | |
| Ti-3% Al-1.0% V-4.6% Cu | 1405 | 4276 | 13.6 | 25.4 | 6.5 |
| Ti-3% Al-1.0% V-4.6% Cu-4.5% $MoS_2$ | 1169 | 4572 | 7.3 | 13.5 | 4.7 |

Figure 6:
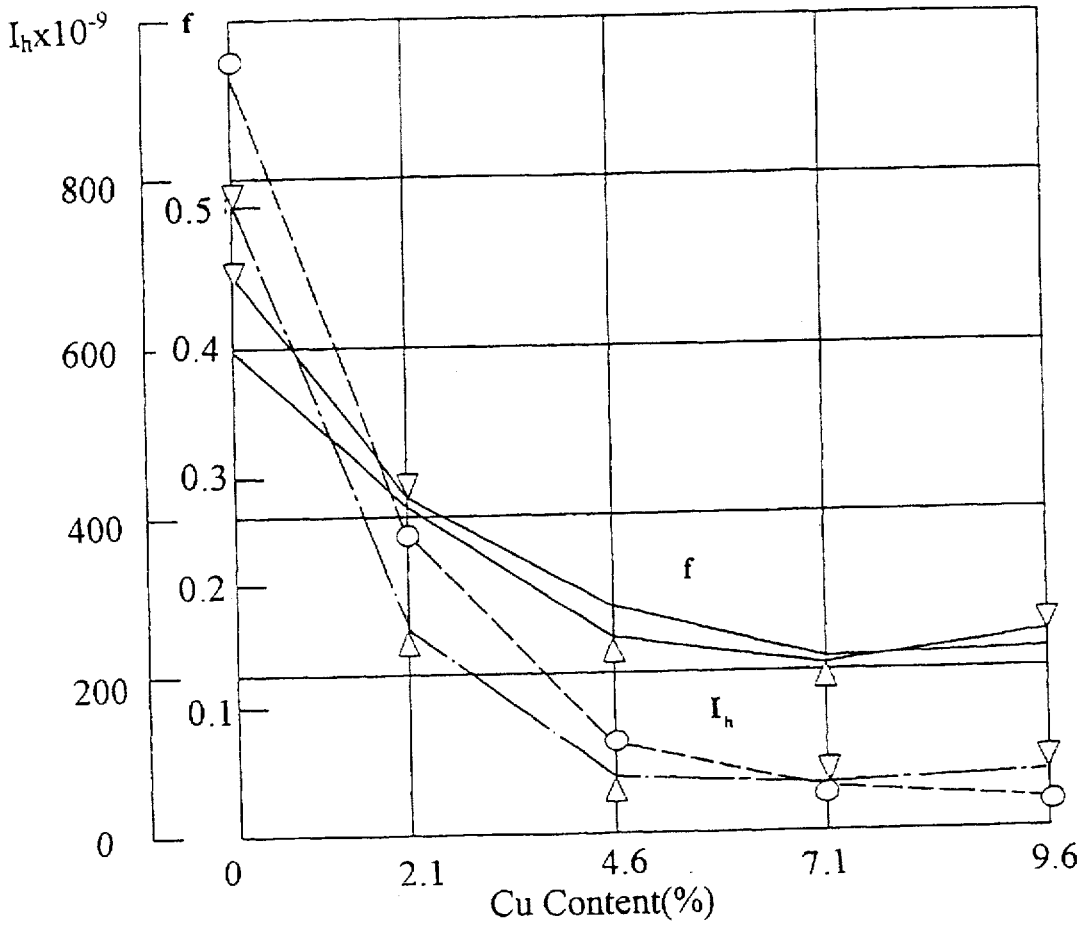
FIG. 6 The dependence of friction coefficient f and linear wear coefficient $I_h$ on the copper content, under constant 1.0 MPa pressure and 1.0 m/s velocity.
Figure 7:
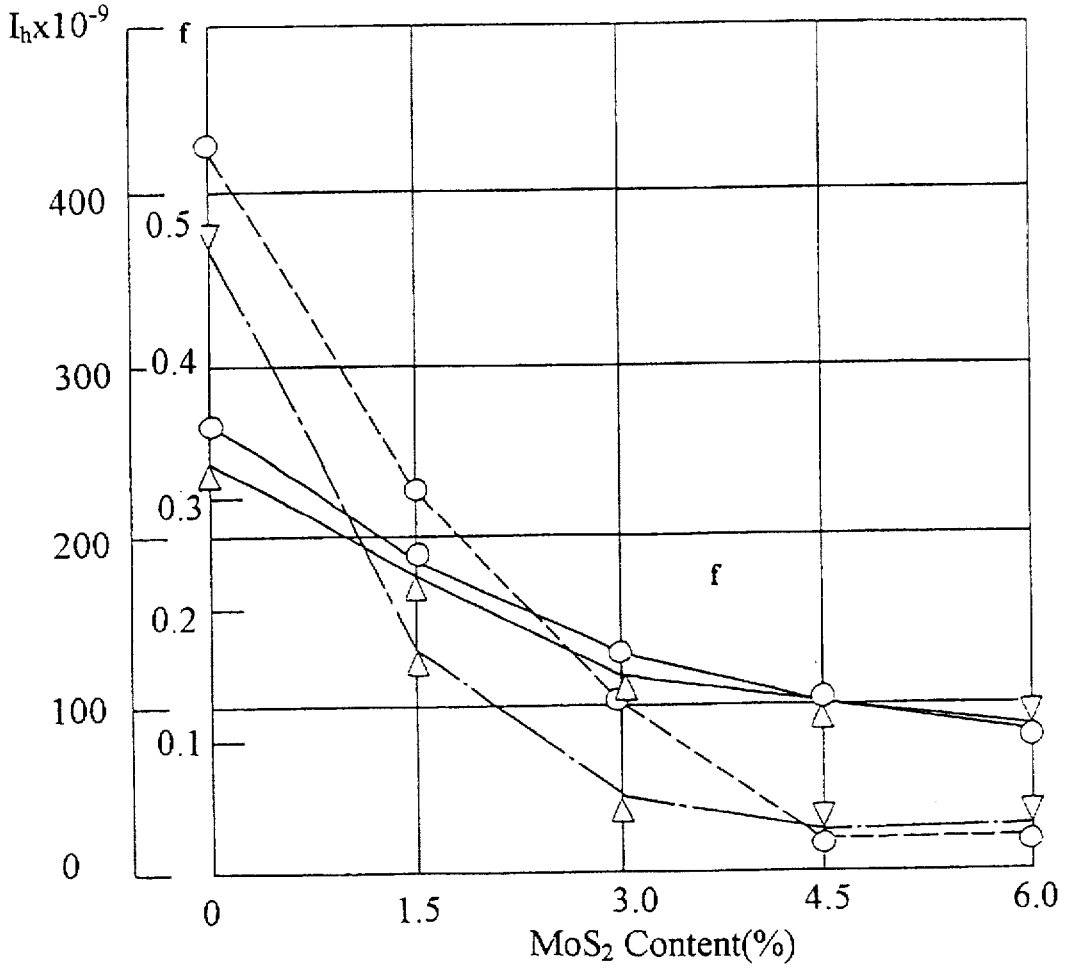
FIG. 7 The dependence of friction coefficient f and linear wear coefficient $I_h$ on Molybdenum Sulfide content under constant 1.0 Mpa pressure and 1.0 m/s velocity.

Studies on friction and wear resistance of Titanium alloys are fulfilled in accordance with code 26614-85. Tests are conducted under dry friction conditions (code 16429-70). As expected (FIG. 6), the intensity of linear wear (Jn) is decreased by increasing the Cu content in the alloy, i.e. the mechanism of intermetallic reinforcement is operated. The same tendency is observed also for the friction coefficient (*f*). The influence of $MoS_2$ on the character of curves Jn and *f* is analogous (FIG. 7), FIG. (8) and FIG. (9) show the results of different tests.

Figure 8:
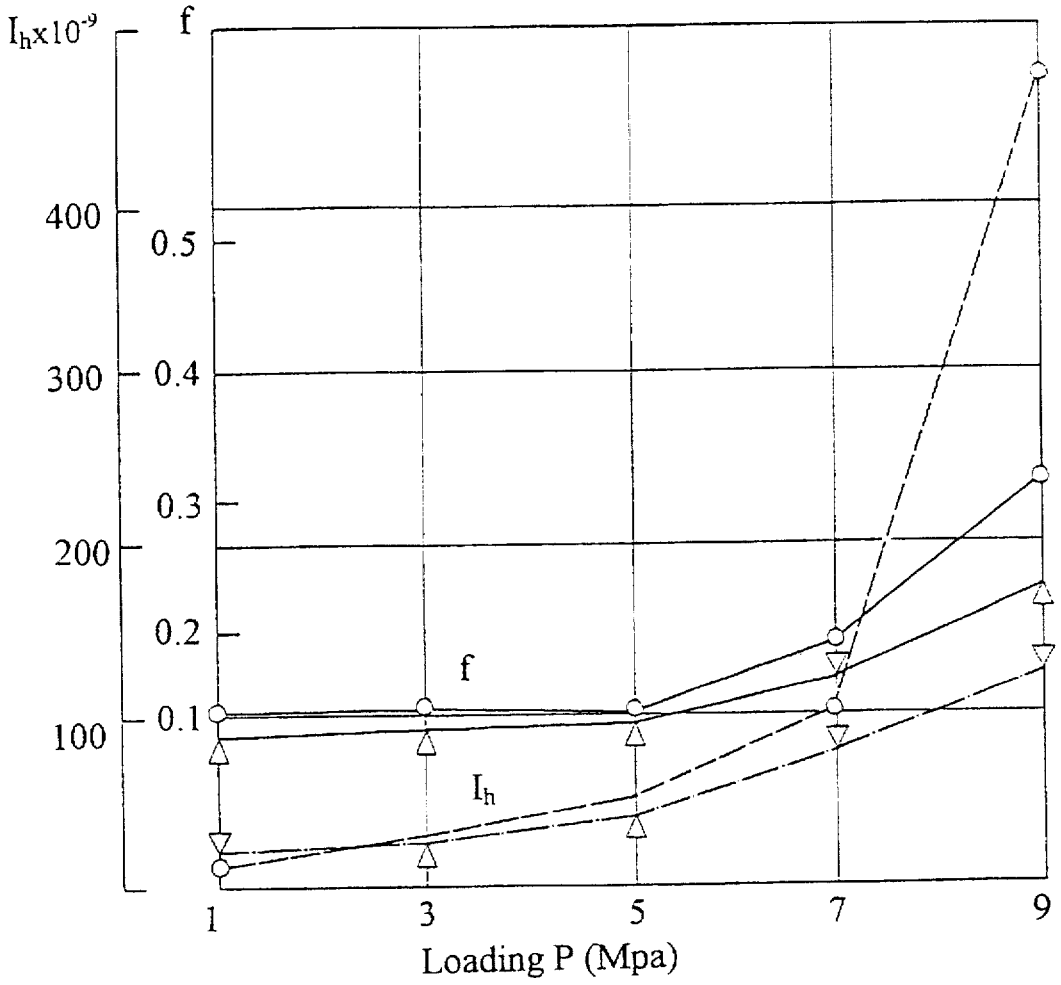
FIG. 8 The dependence of friction coefficient f and linear wear coefficient $I_h$ on copper and Molybdenum Sulfide content, under constant 1.0 m/s velocity and variable pressure.
Figure 9:
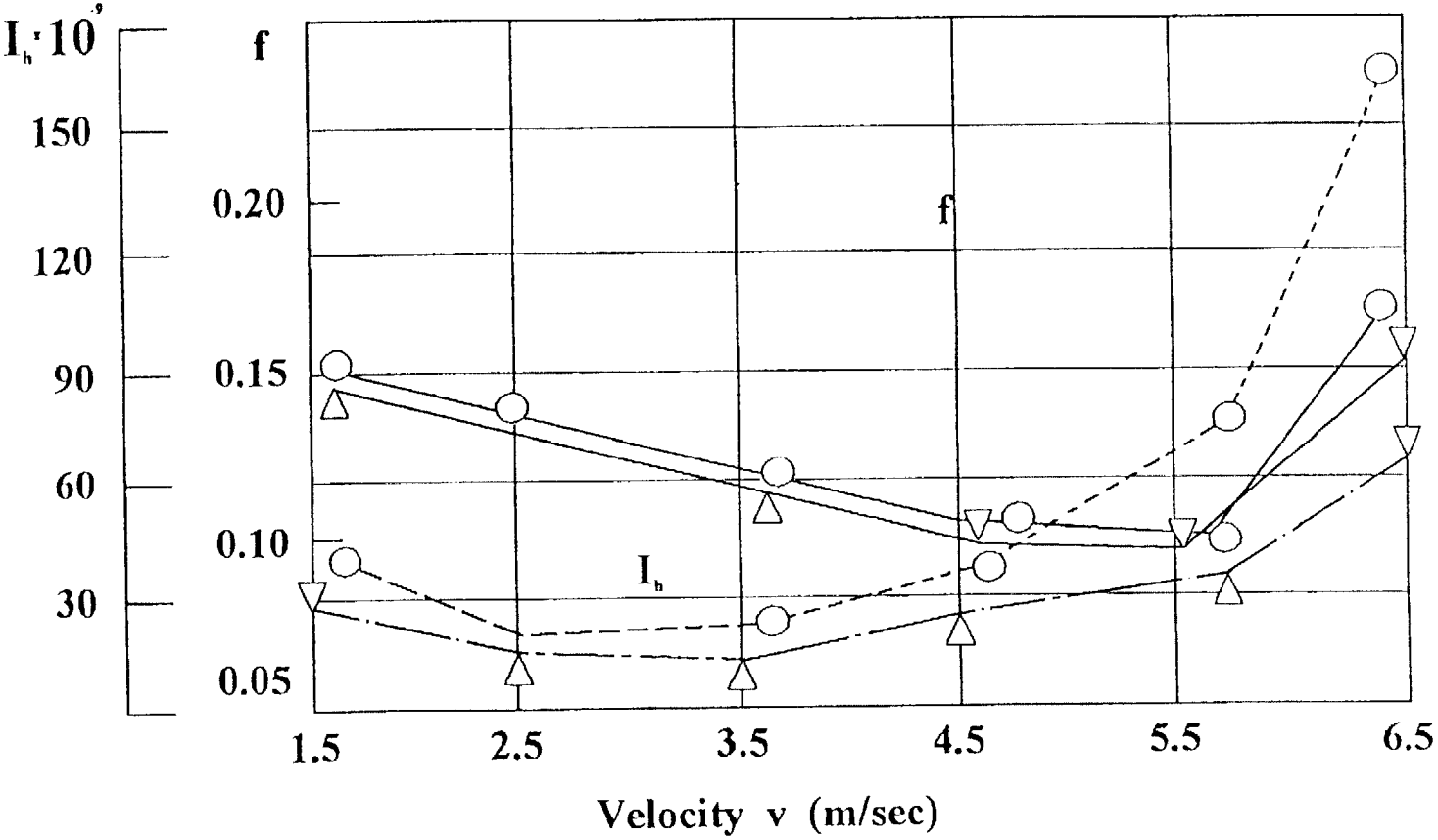
FIG. 9 The dependence of friction coefficient f and the linear wear coefficient $I_h$ on Copper and Molybdenum Sulfide content, under constant 3.0 MPa pressure and variable velocity.

The analysis of FIGS. (6–9) shows that Ti—Al—V—Cu—$MoS_2$ alloys are significantly better by their tribotechnical properties than that of Ti—Al—Cu—$MoS_2$. It is especially noticeable at the condition tests (FIGS. 8 and 9). The workability of titanium alloy with vanadium at P>7 MPa and V>5.5 m/s is within the norm, whereas the same conditions are limit conditions for the alloy without vanadium. This is explained by the fact, that vanadium maintains the natural fine grains of the titanium alloy. At the aging of titanium alloys vanadium contributes to the extraction of more dispersion particles of intermetallic $Ti_2Cu$ (0.01 to 0.05 mem). The factors, mentioned above, influence positively the strength properties and viscosity of titanium alloys (Table 2) and the wearability (FIGS. 8 and 9).

Thus, these and other experiments allow to find the optimal composition of titanium alloys:

1) Ti—(3 to 5)% Al—(1.0 to 1.5)% V—(4.6 to 7.1)% Cu, for the construction products 2) Ti—(3 to 5)% Al—(1.0 to 1.5)% V—(4.6 to 7.1)% Cu—(3.5 to 6.5)% $MoS_2$, for the antifrictious details of machines The recommended friction parameters are:

$P \leqq 7.0$ to 9.0 MPa, $V \leqq 5.5$ to 6.5 m/s, at which the friction characteristics vary within *f*=0.1 to 0.2; In=(25 to 100)·$10^{-9}$ (dry friction).

NOTE:

The Ti—Al—V—Cu alloy has two phase structure:

1) Phase I: α-Ti (Al,V)—matrix (base) is the solid solution of Al and V in α-Ti with hexagonal lattice (six-sided lattice).

2) Phase II: $Ti_2Cu$ is inter metallic compound which is distributed in Ti—Al—V—Cu alloy in the form of fine particles with size 0.01 to 0.1 μm.

The Ti—Al—V—Cu—$MoS_2$ alloy has three phase structure:

1. Phase I α-Ti (Al,V)—matrix (base);
2. Phase II $Ti_2Cu$—inter metallic;
3. Phase III $MoS_2$, molybdenum disulphate—is distributed in Ti—Al—V—Cu—$MoS_2$ alloy in the form of fine particles.

FIELD OF APPLICATION OF THE INVENTION

1. The field of application of high strength material (alloy) Ti—(3 to 5)% Al—(1.0 to 1.5)% V—(4.6 to 7.1)% Cu, with density $\gamma$=4.53 g/cm$^3$ is defined by mechanical characteristics, shown in table 2 and well-known properties of titanium alloy for a wide temperature range: 73 to 873 k.

The distinctive feature of this alloy is its structural stability, that is formed as a result of aging. This is connected with the equilibrium condition of alloy. $\alpha$-Ti is two-phased by its structure (Al and V are in solution), $Ti_2Cu$ is intermetallic.

Machine parts for different applications can be made of proposed alloy: shafts, gears, disks, connecting rods, thread connections, pistons, belts, etc.

Titanium alloy Ti—Al—V—Cu and products, produced by this alloy are obtained by vacuum smelting, casting and by powder metallurgy.

2. The field of application of antifriction alloys

Ti—(3 to 5)% Al—(1.0 to 1.5)% V—(4.6 to 7.1%)Cu—(3.5 to 6.5)% $MoS_2$, with density $\gamma$=4.52 g/cm$^3$ ($\gamma_{MoS_2}$=4.5 g/cm$^2$) is defined by mechanical characteristics (Table 2) and tribotechnical properties, shown in FIGS. 6–9.

The distinctive feature of this alloy is found in its solutive ($\alpha$-Ti) and intermetallic ($Ti_2Cu$) reinforcement mechanisms, that suppress the adhesive mass transfer in friction couples, and thus eliminate the phenomena of setting, typical for titanium and its alloy.

The presence of $MoS_2$ in the composition provides the positive gradient of mechanical properties by depth due to formation of secondary structures on contacting surfaces, and thus, prevents the scuffing and depth excavation of materials of the friction couples.

With this sense the main advantage of antifriction materials is the workability at dry and boundary friction conditions. The following can be made of this materials: shells, guides, sleeves, piston rings, compacting rings, stator rings, gear blocks, cylinder liners, etc.

Titanium alloy Ti—Al—V—Cu—$MoS_2$ and articles made of it can be produced by powder metallurgy technology (due to $MoS_2$).

3. The perspectives of scientific search are the following:

3.1. The modification of Ti—Al—V—Cu alloy, in particular, the increase of Al content to 16%, improvement of production technology 3.2. Use of different compounds as hard Lubricating substances, in particular, the use of selenides e.g. ($MoS_2$), that has higher antifrictions properties than sulphides.

3.3. Structure and properties of titanium alloy mentioned above are defined by two reinforcement mechanisms: solutive ($\alpha$-Ti) and intermetallic ($Ti_2Cu$). There is a possibility for the third reinforcement mechanism that would increase the heat stability and heat-resistance.

3.4. To develop analogous models of alloy on basis of Al, Mg, Be and Fe. We fulfilled several studies for Al, Cu, Fe and obtained very valuable results.

3.5. Scientific search for finding applications of materials with related to para 2 and 3 and multi-link reinforcement mechanism on basis of Ti, Al, Mg, Be, Fe. The working conditions predetermine demands of materials that are used in design, e.g., it is possible to get reinforcement materials on iron basis for firearms (barrels of different gages) with long service life.

Thus, lightness of titanium alloy ($\gamma$=4.2 to 4.3 g/cm$^3$), its workability in wide range of temperature (7.3 to 873 K), and in dry friction and aggressive medium conditions, including depth vacuum, define a wide application field, especially in transport and aircraft engineering, including cosmic engineering.

LIST OF REFERENCES

1. Glazunov, S. G., Moiseev V. N, Structural alloys of Titanium Metallurgia, Moscow 1974, pp 368.
2. Zwicker U., Titanium und Titanlegierungen (German publication), New York, 1974.
3. Chechurin, B. B., Ushakov, S. S., Razuvaeva N. N. Goldarain, L., Titanium alloys in machine manufacturing, Machinostroenie, Leningrad 1977.
4. Francevich, I. N., et al. Constructional metal-ceramic material on the Titanium basis. Published in B.I. 1974.
5. Francevich, I. N., et al, Frictionless composition on the baked Titanium bases, Powderize Metallurgy 1978, No.1, pp 61–65.
6. Frehn F., Patent #2046614 (FRG), Gesinterte Titanlegierund.
7. Radomiselsky, I. D. et al, Titanium wearing resistance increment by means of hard compositions injection.. Baked construction materials. I.P.M. Academy of Science of the USSR, Kiev 1976, pp 113–117.
8. Petrova, A. M., et al, Structure and characteristics of the baked titanium material, which contains hard melting compositions, during various injection methods in the mixture. Baked Construction Materials, I.P.M. Academy of Science of the USSR, Kiev 1976, pp 129–133.
9. Radomiselsky, I. D. et al, Study of the friction and wearing of the baked titanium materials. Powderize Metallurgy 1977, No.6, pp 73–78.
10. Bowden, F. P., et al, Applied physics, 1966, Vol 17, pp 1680.
11. Kragelsky, I. V., Friction and wearing, Machinostroenie, Moscow, pp 1968–1974.
12. Wolf, B. K., Heat treatment of the titanium alloys, Metallurgia, Moscow 1969, pp 374.
13. Kornilov, I. I., Titanium, Nauka, Moscow 1975.
14. Mcquillan, M. K., Phase transformation in titanium and its alloys. Imperial Metal Industries, Ltd., Birmingham, Metallurgical Reviews, 1963, Vol 8, No.29.
15. Brutzen, F. R. et al, Metals, 1955, Vol 7, No.2, pp 413–419.
16. Kolachev, B. A. et al, Mechanical characteristics of titanium and its alloys, Metallergia 1974, pp 544.
17. Ermenko, V. N., Polycomponent titanium alloys, Naukova Dumka, Kiev 1962, pp 210.
18. Milton, B. et al, Titanium base alloys, U.S. Pat. No. 2,880,089 Mar. 31, 1959.
19. Harold, M. et al, Titanium base alloys, U.S. Pat. No. 3,069,259, Dec. 18, 1962.
20. Van Wyk, J. W. et al, High strength self lubricating materials, U.S. Pat. No. 3,479,289, Nov. 18, 1969.
21. Venkataraman et al, Dispersion strengthened Tri-Titanium Aluminum alloy, U.S. Pat. No. H887, Feb. 5, 1991.

What is claimed is:

1. A two phase high strength metal alloy, consisting essentially of 3.0 to 5.0% aluminum, 1.0% to 1.5% vanadium, 4.6% to 7.1% copper and the balance titanium, having the mechanical properties as shown in Table 2 of the specification.

2. A three phase metal alloy, consisting essentially of 3.0 to 5.0% aluminum, 1.0% to 1.5% vanadium, 4.6% to 7.1% copper, 3.5% to 6.5% $MoS_2$ and the balance titanium, having the mechanical properties as shown in Table 2 of the specification and a low coefficient of friction.

* * * * *